United States Patent [19]

Toyoda

[11] 4,393,776

[45] Jul. 19, 1983

[54] INK FOUNTAIN DEVICE FOR USE IN PRINTING PRESS

[75] Inventor: Hideaki Toyoda, Tokyo, Japan

[73] Assignee: Komori Printing Machinery Co., Ltd., Tokyo, Japan

[21] Appl. No.: 292,304

[22] Filed: Aug. 12, 1981

[30] Foreign Application Priority Data

Feb. 20, 1981 [JP] Japan ..... 56-24760

[51] Int. Cl.[3] ..... B41F 31/04; B41F 31/06

[52] U.S. Cl. ..... 101/365

[58] Field of Search ..... 101/365, 157, 169; 118/261; 15/256.5, 256.51

[56] References Cited

U.S. PATENT DOCUMENTS

| | | | |
|---|---|---|---|
| 3,521,561 | 7/1970 | Pali et al. | 101/169 |
| 3,559,573 | 2/1971 | Hantsch | 101/365 |
| 3,978,788 | 9/1976 | Cappel et al. | 101/363 |
| 4,000,695 | 1/1977 | Perretta | 101/365 |

*Primary Examiner*—J. Reed Fisher

*Attorney, Agent, or Firm*—Remy J. VanOphem

[57] ABSTRACT

In an ink fountain device for use in a printing press of the type wherein printing ink is supplied through a gap between an inking roller and an adjustable inclined blade, the blade includes a plurality of juxtaposed sections divided along the inking roller, and a magnetic plate having the same width as the combined width of the blade sections. The magnetic plate is attracted to the blade sections by permanent magnets provided for the respective blade sections. Permanent magnets can also be provided for the respective blade sections or a blade support for firmly attracting the blade sections to the blade support. The construction not only permits fine adjustment of the quantity of ink in each section in accordance with the contrast of printed patterns but also prevents the printing ink from entering between the blade sections and the magnetic plate, and between the blade sections and the blade support.

9 Claims, 16 Drawing Figures

INK FOUNTAIN DEVICE FOR USE IN PRINTING PRESS

BACKGROUND OF THE INVENTION

This invention relates to an ink fountain for use in a printing press constructed to continuously supply a predetermined quantity of ink contained in an ink fountain.

An inking apparatus for supplying printing ink to a plate mounted on a plate of a rotary press generally includes an ink fountain device for supplying a predetermined quantity of ink stored in an ink fountain, and a plurality of roller groups for uniformly supplying to the plate the ink supplied from the ink fountain in various directions. The prior art ink fountain device is constructed as shown by a side view illustrated in FIG. 1. More particularly, there is provided an inclined blade support to the right and beneath an inking roller. Mounted on the upper surface of the blade support is an inking blade made of a resilient thin steel plate and having the same length as the axial length of the inking roller. The lower or outer end of the inking blade faces the periphery of the inking roller with a small gap therebetween. A plurality of adjusting screws arranged in the axial direction of the inking roller and equally spaced from each other by 20–50 mm are threaded through the bottom plate of the blade support to be reciprocable in a perpendicular direction with respect to the rear surface of the inking blade. In a triangular ink fountain defined by the periphery of the inking roller and the inking blade a quantity of printing ink is contained which flows out through a small gap between the periphery of the inking roller and the lower end of the inking blade. When the adjusting screws are advanced to press the rear surface of the inking blade, the gap is narrowed to decrease the quantity of the ink flowing out. Conversely, the quantity of ink flowing out can be decreased by retracting the adjusting screws. The quantity of the ink flowing out can be independently adjusted in respective sections along the inking roller by independently adjusting the adjusting screws, thereby adjusting the quantity of ink in accordance with the contrast of the pattern of the plate.

With such prior art ink fountain devices, however, since the inking blade is constituted by a single blade where it is desired to decrease the quantity of ink at portions corresponding to adjusting screws on both sides and to increase the quantity of ink at a portion corresponding to an intermediate adjusting screw as shown in FIG. 2, even when the adjusting screw is retracted while the adjusting screw are maintained in their advanced positions, the inking blade would not bend downwardly because it is depressed upwardly by the adjusting screws. To eliminate this difficulty, the adjusting screws on both sides are slightly retracted which results in a rough adjustment as shown in FIG. 3. Further, advancement of one adjusting screw has an influence on both sides thereof, thus failing to realize accurate adjustment.

Consequently, it has been proposed to divide the inking blade into a plurality of sections along the axis of the inking roller, which are adjustable independently. With this construction, however, the ink enters into the sliding surfaces of the blades and the blade support as well as the adjusting means through gaps between adjacent divided blade sections with the result that fine adjustment becomes impossible due to ink or its residue.

It is a difficult operation to remove such ink or ink residue, thus making it difficult to maintain. According to another proposal, the divided blade sections are superimposed on inking blades in direct contact with the ink. In this construction, however, as the contact area between two blades is small, there is a tendency of the ink to leak to the outside.

SUMMARY OF THE INVENTION

It is an object of the present invention to provide an improved ink fountain device capable of precisely adjusting the quantity of ink supplied in respective sections divided along the length of an inking roller according to the contrast of a printed pattern.

Another object of this invention is to provide an improved ink fountain device for use in a printing press capable of preventing leakage of ink.

Still another object of this invention is to provide a novel ink fountain device for use in a printing press that can be readily mounted, dismounted and cleaned.

According to this invention there is provided an ink fountain device for use in a printing press including an inking roller immersed in printing ink contained in an ink fountain, a blade support, a plurality of blade sections juxtaposed on the blade support along the length of the inking roller, means for independently adjusting gaps between front ends of the blade sections and the periphery of the inking roller, magnetic thin plate mounted on the blade sections, the thin magnetic plate having substantially the same width as that of all the juxtaposed blade sections, and a plurality of permanent magnets respectively provided for the blade sections beneath the thin magnetic plate for attracting the same to the blade sections.

DESCRIPTION OF THE PREFERRED EMBODIMENTS

Figure 1:
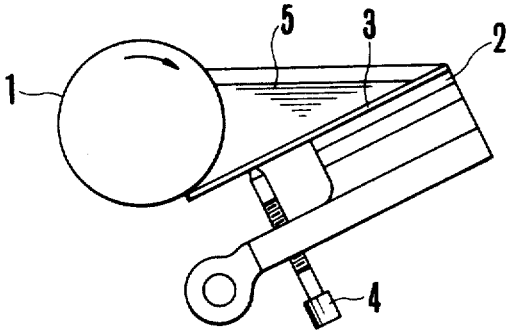
FIG.1 PRIOR ART
FIG. 1 is a side view showing a prior art ink fountain device.

An ink fountain device 11 shown in FIGS. 4 through 7 includes an inking roller 12 pivotally supported by the frame of a printing press, not shown, to be rotatable in a direction of arrow A, a pivot shaft 13 at the right and lower side of the inking roller 12 and a blade support 14 having substantially the same length as the inking roller 12 and with its fore end pivotally mounted on the pivot shaft 13. The blade support 14 is constituted by a hub 14*a* pivotally mounted on the pivot shaft 13, a blade supporting member 14*b* and an inclined reinforcing member 14*c* extending from the right lower portion to an intermediate portion of the blade supporting member 14*b* which are integrally formed. The blade support 14 is disposed with its fore end lower. Above the reinforcing member 14*c* is provided a rectangular stay 15 with both ends supported by the blade support 14. A plurality of adjusting screw holders 16 are mounted on the rear end of the blade support 14 corresponding to the respective blade sections 25 for supporting the adjusting screws 17, the axial movement thereof being limited by flanges and collars 18 of the screws 17. The threaded portion of each adjusting screw 17 is received in a threaded opening of a link holder 19, the upper surface thereof slidably engaging the lower surface of the stay 15. A bearing 20 is provided for the front surface of the stay 15. A plate link 21 is pivotally connected to the link holder 19, and other plate links 23 are concentrically mounted on an eccentric shaft 22 supported by the bearing 20. Both the links 21 and 23 are pivotally interconnected in the form of a letter L so as to connect the link holder 19 to the bearing 20.

An eccentric center of the eccentric shaft 22 is received in a U shaped groove of a T shaped blade holder 24.

Figure 6:
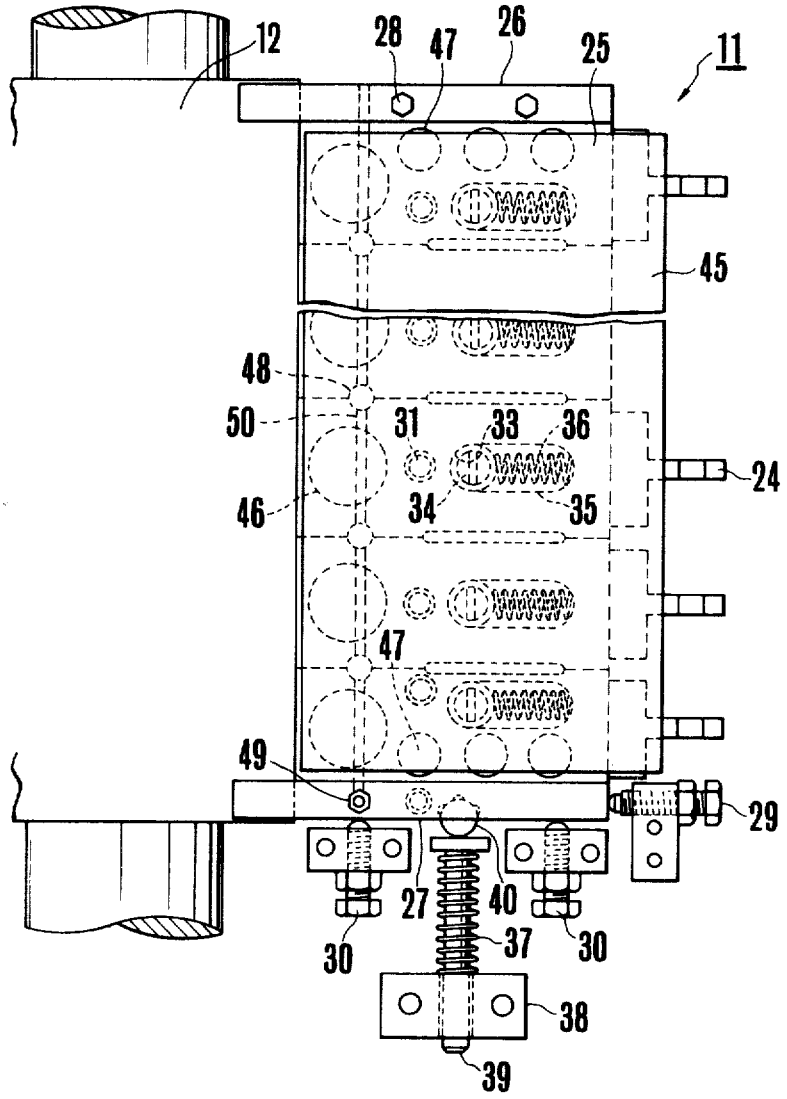
FIG. 6 is a plan view showing the ink fountain device of the present invention, except the adjusting mechanism.
Figure 8:
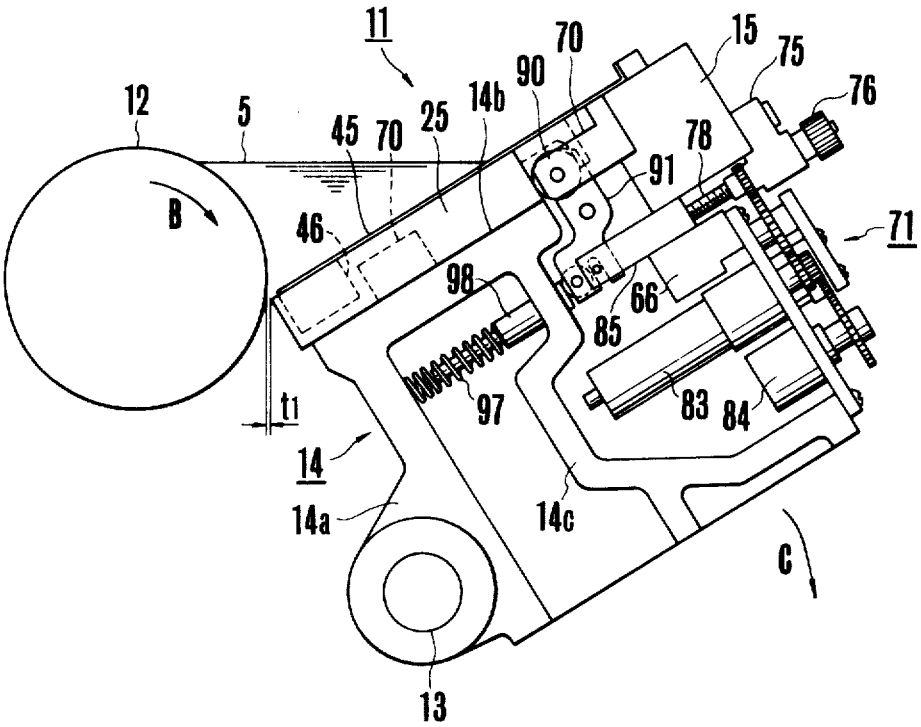
FIG. 8 is a side view showing a modified embodiment of this invention.

The blade sections 25 are secured to the blade holder 24 at their rear ends and juxtaposed on the supporting member 14*b* with their side surfaces closely adjacent. Further, a pair of triangular side plates 26 and 27 are provided having arcuate front edges in intimate contact with the periphery of the inking roller 12. One of the side plates 26 is secured to the blade support 14 with bolts 28 as shown in FIG. 6. The other side plate 27 is movable toward and away from the inking roller and held in light contact with the periphery of the inking roller 12 by a pressing bolt 29. The side plate 27 is urged by bolts 30 to prevent lateral movement of the blade sections 25. Each of these closely juxtaposed blade sections 25 takes the form of a rectangular plate and its finished lower surface is urged against the finished upper surface of the blade supporting member 14*b* by a compression spring 32 about a stud 31. A stub opening 33 is provided through the central portion of each blade section 25 to receive the head of a stub 34 threaded into the blade support 14, the outer diameter of the head being made smaller than the inner diameter of the stud opening 33 by the degree of adjustment of the blade section 25. The opening for receiving the stud 31 is also made large enough to permit adjustment of the blade sections 25. Each blade section 25 is moved toward and away from the inking roller 12 by the adjusting screw 17 via the link holder 19 the, links 21 and 23, the bearing 20 and the eccentric shaft 22 so as to adjust the gap d (shown in FIG. 5) between the blade sections 25 and the inking roller 12. Each blade section 25 is urged to move away from the inking roller 12 by a compression spring 36 contained in an elongated slot 35 formed in the upper surface of the blade. Further, the blade sections 25 are urged in the lateral direction by a compression spring 37 provided for the side plate 27 (see FIG. 6). More particularly, as shown in FIG. 6, a stud 39 slidably supported by a bearing 38 is provided on the outer side of the side plate 27 and a compression spring 37 is interposed between the head of the stud 39 and the bearing 38. A ball is interposed between the head of the stud 39 ane the side plate 27. Thus, the compression spring 37 applies a light pressure to the blade sections 25 so as to cause their side surfaces to firmly contact with each other and to permit the blades to move toward and away from the inking roller 12.

A plurality of screw holders 41 are mounted on the upper surface of the stay 15 for supporting adjusting screws 42, the axial movement of each adjusting screw being limited by its head and collar 43. Threaded portions of each adjusting screw engages a threaded opening of an L shaped holder 44 having substantially the same length as the inking roller 12. The L-shaped holder 44 is connected to the rear end of a thin steel plate 45 having a length slightly longer than that of all blade sections and a width substantially the same as that of each blade section 25. The thin steel plate 45 is mounted on the upper surface of the blade support 14 and the gap S (see FIG. 4) between its fore end and the periphery of the inking roller 12 and is adjustable by the adjusting screw 42.

Permanent magnets 46 and 47 are embedded in the front portions of the respective blade sections 25 and in two blade sections on the opposite sides for attracting the thin steel plate 45 thus urging them against the upper surface of the blade support 14. This construction prevents the ink from flowing across the front and side edges of the thin steel plate 45. The magnets are also effective to prevent the ink from flowing through the gaps between the side plates 26 and 27 and the thin steel plate 45.

Grease openings 48 are provided between the interfaces of the adjacent blade sections. These grease openings 48 are connected to a grease nipple 49 provided for the side plate 27 through grease conduits 50. The grease conduit 52 with its fore end closed by a lid 51 is provided on the upper end of the blade support 14. The grease conduit 52 extends across the width of the blade support 14 and is communicated with a grease nipple 53 on the lower surface of the blade support 14. Perforations 54 are provided for inserting a tool utilized to dismount the permanent magnets 46 and 47.

In the ink fountain device described above, the ink fountain is defined by the periphery of the inking roller 12, two side plate 26 and 27 with their front edges urged against the inking roller 12, and thin steel plate 45 to contain a quantity of printing ink 5. The gap S between the thin steel plate 45 and the periphery of the inking roller 12 is adjusted by the adjusting screw 42 to correspond to an expected maximum thickness of the ink film. The blade sections 25 are urged towards each other by advancing bolts 30 on one side thereof. After this adjustment, the stud 31 is advanced to compress the spring 32. Then the bolts 30 are slightly loosened to separate from the side plate 27, thus causing only the compression spring 37 to act. Concurrently with the pouring of the ink, grease is filled in grease conduits 50, 52 and grease openings 48 through the grease nipples.

Figure 2:
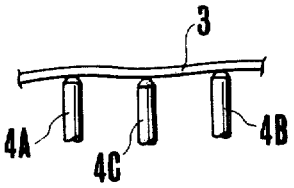
FIG.2 PRIOR ART
FIGS. 2 and 3 are diagrammatic representations of the adjusting screws.
Figure 3:
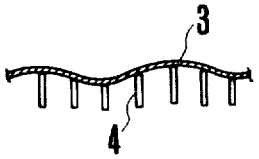
FIG.3 PRIOR ART
Figure 4:
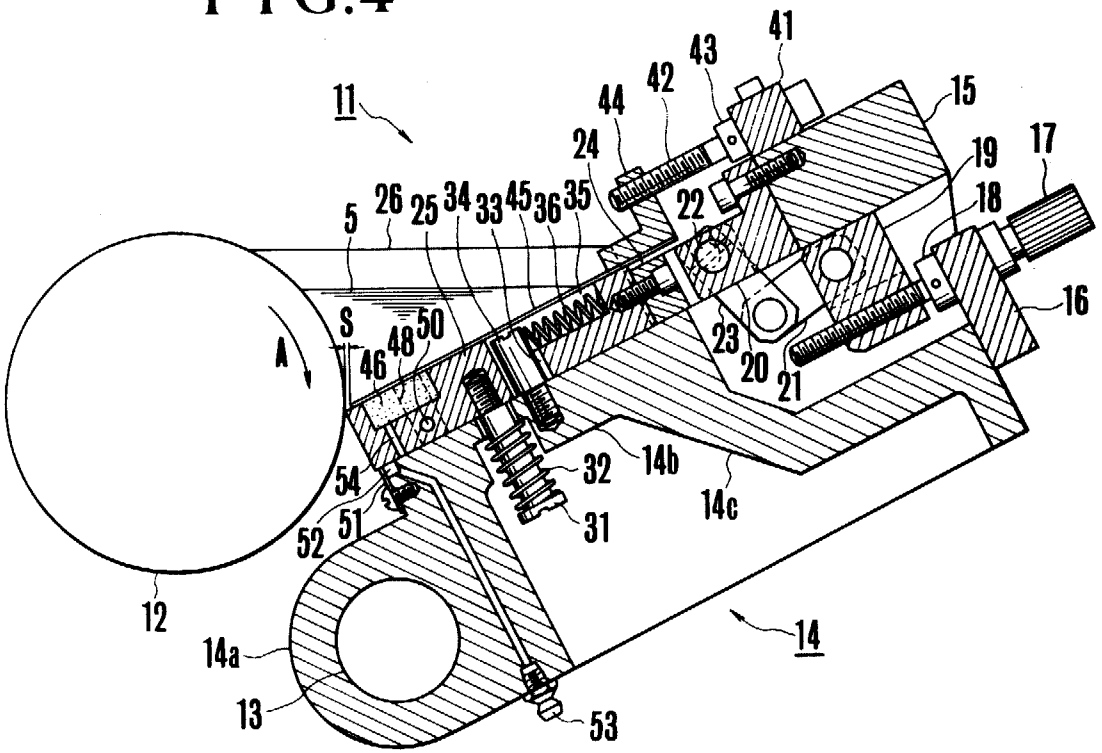
FIG. 4 is a longitudinal sectional view showing one embodiment of the ink fountain device for use in a printing press constructed according to the present invention.
Figure 5:
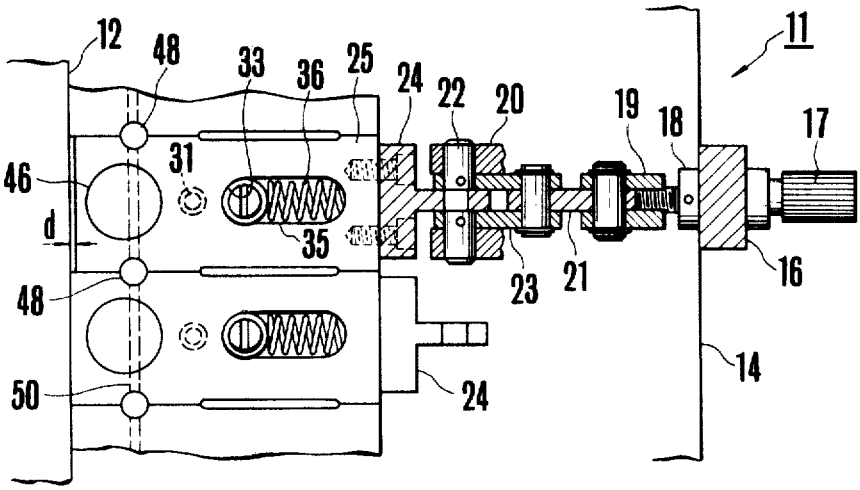
FIG. 5 is a side view, partly in section, showing the connection between an adjusting screw and a blade section.
Figure 7:
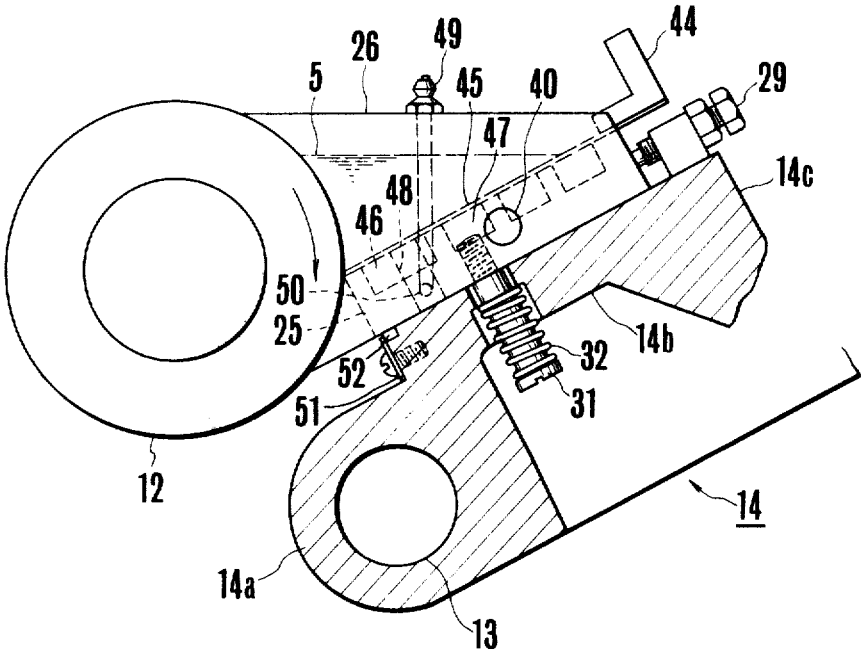
FIG. 7 is a side view, partly in section, showing the essential portions of the ink fountain device according to this invention.

Upon rotation of the inking roller 12, the printing ink 5 is forced out through the gap d between the periphery of the inking roller 12 and the blade sections 25 to form an ink film about the periphery of the inking roller 12. The gaps d are adjusted for respective blade sections 25 according to the contrast of the pattern of the printed matter. To this end, the adjusting screws 17 are rotated to slide the ink holder 19 along the stay 15 so as to rotate the eccentric shaft 22 via the plate links 21 and 23. Due to the eccentricity of the eccentric shaft 22, rotation thereof causes the blades sections 25 to reciprocate with respect to the inking roller 12, thereby adjusting the gaps d. At this time, although the eccentric portion of the eccentric shaft 22 moves slightly in the vertical direction, since it is supported by a U shaped portion, it can rotate smoothly. Each blade section 25 is biased by the compression spring 36 in a direction to increase the gap d and since any play at the respective connections between the adjusting screw 17 and the blade sections 25 is eliminated it is possible to obtain a fine adjustment. As above described, each blade section 25 is accurately and finely adjusted without influencing the other blade section, so that the defect described in connection with FIGS. 2 and 3 can be eliminated, thus accurately adjusting the quantity of ink commensurate with the pattern. Further, as the grease conduits 50 and 52 are filled with grease any blade section 25 can slide smoothly with respect to the other blade section and to the blade support 14.

As above described, the printing ink 5 continuously flows out though the gap d. At this time, although the printing ink 5 tends to hydraulically raise the fore end of the thin steel plate 45, since the plate is attracted by the permanent magnets 46 and 47 to the blade sections 25, the ink does not enter between the thin steel plate 45 and the blade sections 25 through the gap S at the front end of the thin steel plate and through the gaps between side plates 26 and 27 and the blade sections 25. Further, since the blade sections 25 are urged together by the compression spring 37, it does not pass through the contact surfaces between adjacent blade sections. Even when the ink tends to enter between these contact surfaces it would be prevented by viscous grease in the grease opening 48 and the grease conduit 50 from entering between the sliding surfaces of the blade sections 25, thus insuring fine adjusting performance. Furthermore, the ink which otherwise tends to enter the sliding surfaces of the blade sections from the front ends is prevented by the grease in the grease conduit 52. Also the compression spring 37 permits thermal expansion of the blade sections 25 during operation. And, as the adjusting mechanism of the blade sections 25 and the thin steel plate 45 are located at a level higher than that of the ink, they would not be contaminated by ink or ink residue, thus preventing its interference with the required fine adjustment.

During interuption of the printing operation, the ink fountain can be cleaned, and when different ink is to be used, the ink fountain, must be cleared of a previous ink before the different ink is put into it. To this end, after discharging the ink from the ink fountain, the entire ink fountain device 11 is rotated about the pivot shaft 13 and the bolts for fastening the plurality of screw holders 41 are loosened. Then, it is possible to readily dissemble the thin steel plate 45, the screw holder 41 and the adjusting screws 42.

Although in the foregoing embodiments the blade sections 25 are urged against the blade support 14 by the compression springs 32, these springs may be substituted by permanent magnets. Further, viscose silicone oil or silicone rubber can be used in place of grease.

As above described, according to this invention, a plurality of blade sections are juxtaposed on a blade support, magnetic thin plates are superimposed on the respective blade sections, and permanent magnets are embedded in respective blade sections to attract the thin magnetic plate to the upper surfaces of the blade sections so that it is possible to finely and accurately adjust the quantity of ink supplied in a plurality of sections along the length of an inking roller. As a consequence, it is possible to adjust the quantities of the ink supplied in accordance with the contrast of the printed pattern. Further, as it is possible to prevent leakage of ink from the ink fountain the sliding surfaces will be subject to no ink trouble. Moreover, the thin magnetic plate can be readily mounted and dismounted maintenance and cleaning.

In the modification shown in FIGS. 8 through 12 elements corresponding to those shown in the previous embodiment are designated by the same reference characters. The construction and relative arrangement of the inking roller 12, the blade support 14 and the rectangular stay 15 are the same as before. In this modification a small stay 66 having the same length as the rectangular stay 15 is secured thereto by bolts 68 at both ends with spacers 67 interposed therebetween. The ink fountain device constituted by the blade support 14, the rectangular stay 15 and the small stay 16 is provided with a plurality of blade sections 25 and a plurality of thin steel plate 45 superimposed thereon. Each blade section 25 is formed with a perforation 60 which receives the head of an eccentric pin 61 threaded into the blade supporting member 14. The head of the pin 61 is provided with a groove for receiving a driver and a spring seat 62 acting as an eccentric member mounted on the eccentric pin 61 eccentrically with respect to the axis thereof. A spring groove 63 is formed in the upper rear half of each blade section 25 to communicate with the perforation 60 for receiving a compression spring 64 held in the groove 63 by a L shaped holder 65 secured to the blade section 25 by screws. When the eccentric member 62 is brought to the position shown in FIGS. 9 and 10 by rotating the eccentric pin 61, the compression spring 64 urges the blade section 25 rearwardly, whereas when the eccentric pin 61 is rotated 180° to a position shown by dot and dash lines, the spring 64 releases the blade section 25. A click mechanism constituted by a ball 66 and a compression spring 67 is provided for the eccentric pin 61 for holding it in the operated and release positions.

In this modification, the rear end of the thin steel plate 45 superimposed the blade sections 25 is secured to the square stay 15. Again, cylindrical permanent magnets 46 are embedded in the upper surfaces of the blade sections 25 to attract the steel plate 45 to the upper surfaces of the blade sections 25. Similar cylindrical permanent magnets 70 are embedded in the lower surfaces of the blade sections 25 at portions on the rear side of the magnets 46 for magnetically urging the blade sections 25 to the upper surface of the blade support 14.

Each blade section 25 is provided with the following gap adjusting mechanism. Thus, a plurality of adjusting units 71 are provided for the respective blade sections 25 between the small stay 66 and the lower rear end of the blade support 14. The adjusting unit 71 includes an elongated rectangular base plate 72 which is provided with an electric motor 73 and a potentiometer 74 which are connected to a control panel not shown, the shafts of the motor and potentiometer extending to the outside of the base plate 72. A bracket 75 secured to the rear side of the square stay 15 supports threaded rods 78 whose axial movements are limited by knobs 76 and gears 77.

Figure 9:
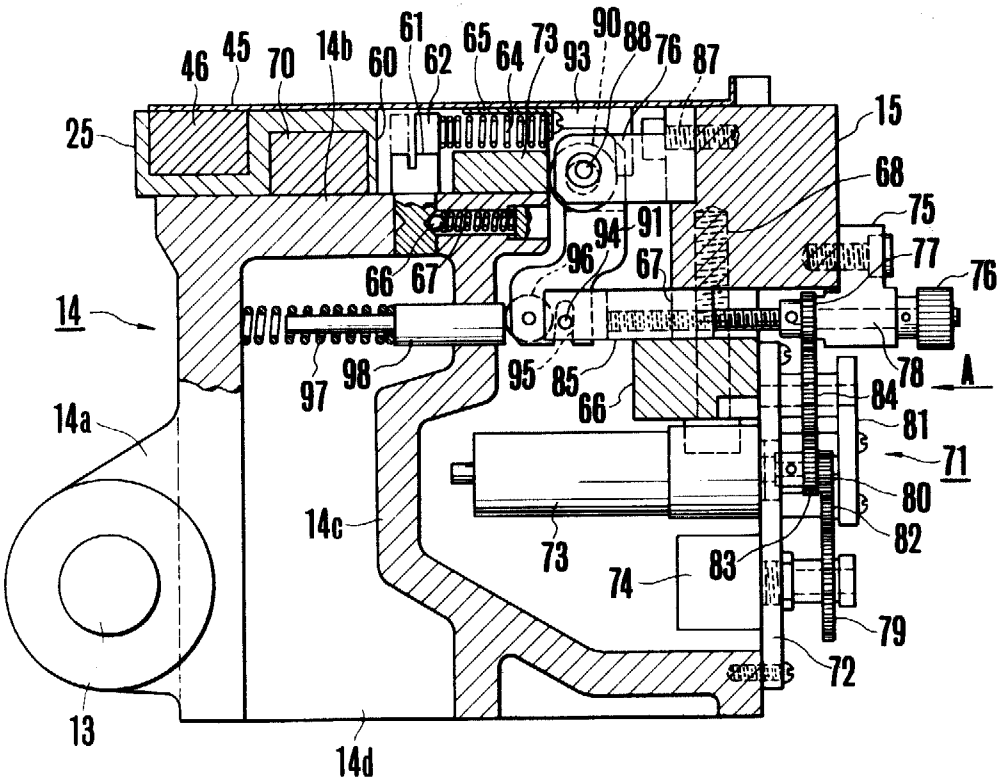
FIG. 9 is a longitudinal sectional view of the embodiment shown in FIG. 8.
Figure 11:
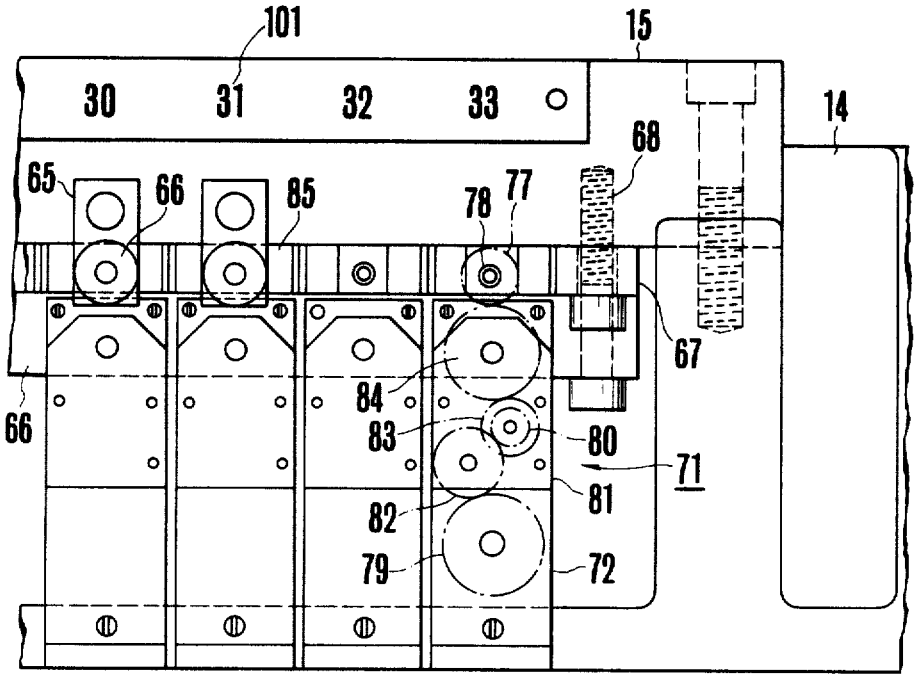
FIG. 11 is an end view of the modification shown in FIG. 9 as viewed in the direction of arrow A.
Figure 12:
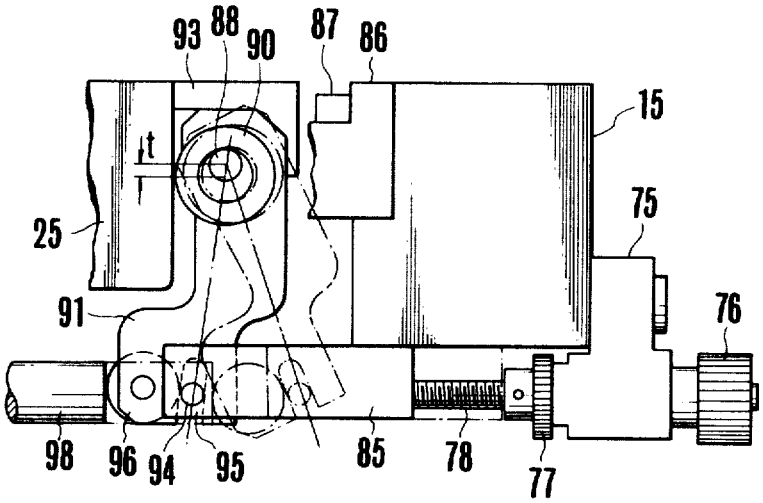
FIG. 12 is an enlarged view showing a divided blade adjusting mechanism.
Figure 13:
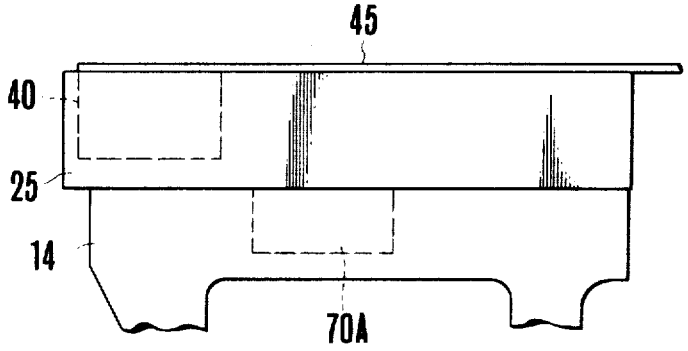
FIGS. 13 and 14 are side views showing still other modifications of the present invention.

FIG. 11 shows one of the gear trains. AS shown, a gear 79 mounted on the shaft of the potentiometer 74 and a gear 80 mounted on the shaft of the motor 73 are coupled together through an intermediate gear 82 of a gear shaft journalled by the base plate 72 and an outer plate 81. A gear 83 integral with the gear 80, and a gear 77 on the threaded rod 78 are coupled together through an intermediate gear 84 on a shaft journalled by the base plate 72 and the outer plate 81. As shown by an enlarged view in FIG. 12, the forwardly projecting portion of the threaded rod 78 is threaded into a slider 85 having a width slightly smaller than the width of one blade section 25 and a bifurcated front end. The slider 85 is reciprocated forwardly and backwardly by being guided by the square stay 15 and the small stay 66 when the threaded rod 78 is rotated. To the front surface of the square stay is secured by bolts 87 a bracket 86 with its fore end bifurcated and an eccentric pin 88 is rotatably received in an opening at the front end of the bracket 86 through a drive bearing 89. The central portion of the eccentric pin 88 has an eccentric portion having an eccentricity t with respect to both supported ends. On the eccentric portion a ball or roller bearing 90 is mounted. The upper bifurcated portion of a lever 91 is fitted on the portion of the eccentric pin 88 which is concentric with both ends to clamp the ball bearing 90. The eccentric pin 88 is secured to the lever 91 by a set screw 92. An inverted L shaped thin limiting plate 93 is secured to the rear end of each blade section 25 and the ball bearing 90 is disposed between the limiting plate 93 and the rear end of the blade section 25 to be limited in its fore and aft movements. A slot 95 is provided at the lower end of the lever 91 for receiving a pin 94 on the front end of the slider 85. A roller 96 is pivotally supported by the lever 91, and the roller 96 biases the lever 91 in the counterclockwise direction as viewed in FIGS. 9 and 12 by a compression spring 97 through a push pin 98 as shown in FIG. 9.

The modified ink fountain device 11 operates as follows. Prior to the printing operation a quantity of printing ink 5 is put in an ink fountain defined by the inking roller 12, the blade sections 25, the magnetic plate 45, and the triangular side plates 26 and 27 (see FIG. 6). As the printing operation is started, the printing ink 5 continuously flows out through gaps t1 between the periphery of the inking roller 12 and the blade sections 25 as the inking roller 12 rotates and an ink film is formed about the periphery of the inking roller 12 which is supplied to the plate via a plurality of inking rollers as is well known in the art.

The quantities of the ink in respective sections along the length of the inking roller are adjusted in the following manner in accordance with the contrast of the printed matter. At the time of assembling the adjusting mechanisms of the respective blade sections are set to zero. More particularly, after setting the lever 91 and the eccentric pin 88 by the set screw 92 with their center lines aligned, the spacing between the gear 77 and the slider 85 is set to a predetermined dimension. Then, while holding the potentiometer 74 with one hand, its zero position is adjusted by rotating the threaded rod 78 by rotating the knob 76 with the other hand. After performing the zero adjustment in this manner, while observing a proof sheet, the operator depresses a push button of a number corresponding to a number plate 101 shown in FIG. 11 to adjust the quantity of the ink. When the push button is depressed, the motor 73 rotates to rotate the threaded rod 78 through gears 77, 82, 80, 83, and 84. As a consequence the slider 85 is reciprocated to swing the lever 91 between the solid line position and the dash and dot line position shown in FIG. 12 by the engagement of the pin 94 and the slot 95 thereby reciprocating the blade section 25 by the eccentricity of the eccentric pin 88. At this time, since the lever 91 is urged by the compression spring 97 and the blade section 25 is resiliently held by the stopping plate 65 and the spring seat 62 and since the roller 90 on the eccentric pin 88 is firmly clamped between the rear end surface of the blade sections 25 and the limiting plate 93, it is possible to provide an accurate adjustment without any backlash. With this adjustment, the gaps through the blade sections 25 and the inking roller 12, that is, the quantities of ink can be accurately adjusted for respective sections of the blade sections and the result of adjustment, that is, the rotation of the threaded rod 78 is detected by the potentiometer 74 through gears to generate an electric signal which is displayed on a remote operating panel for the operator.

In this embodiment, the ink is prevented from entering into the sliding surfaces between the blade sections 25 and the thin steel plate 45 because the plate is firmly sucked against the upper surfaces of the blade sections by the permanent magnets 46.

Figure 10:
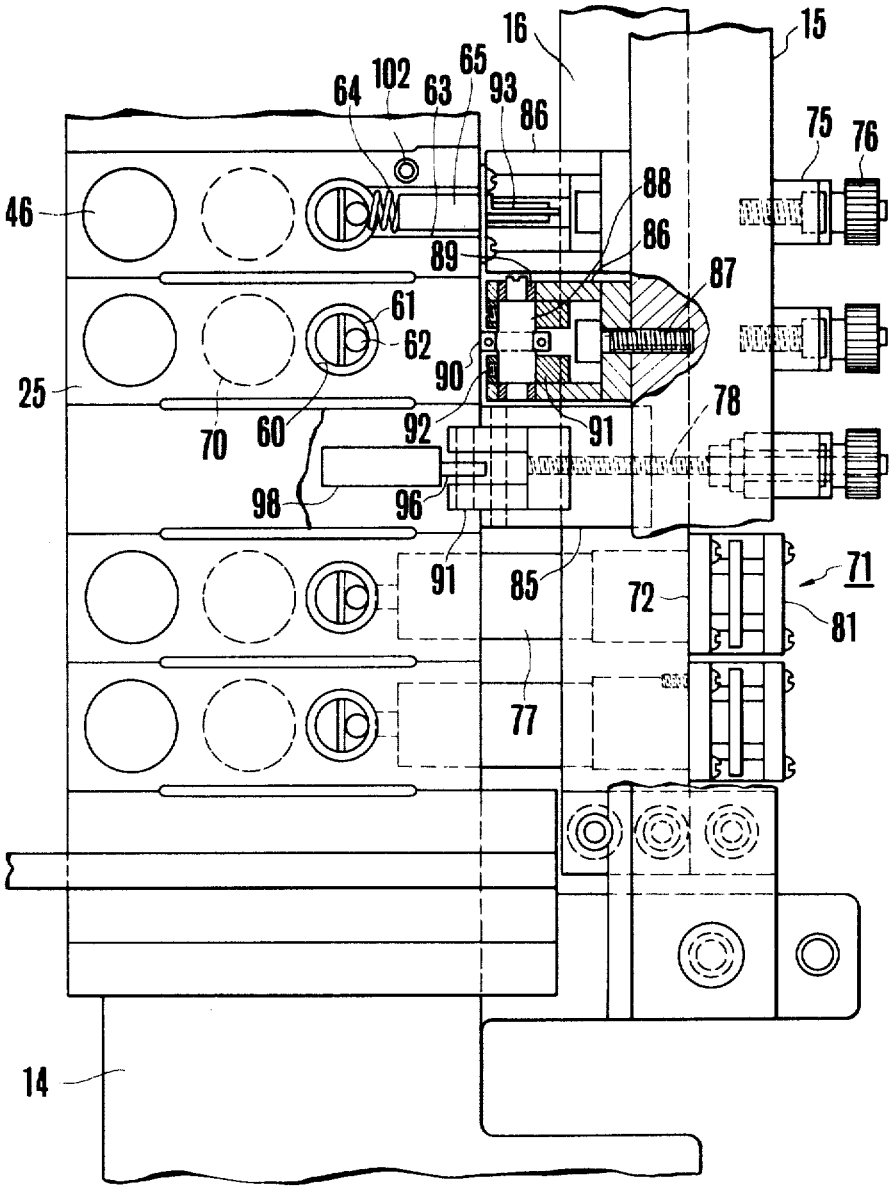
FIG. 10 is a plan view partly in section, of the ink fountain device shown in FIG. 8.

The blade sections 25 are dismounted in the following manner for the purpose of repair, maintainance and cleaning. At first, the steel plate 45 is dismounted from the square stay 15. Then a driver is inserted into a perforation 60 to rotate the eccentric pin 61 180°. Then the spring receiver 62 is moved to a position remote from the compression spring 64 because the spring receiver 62 is in the eccentric position of the eccentric pin 61. Thus, the compression springs 64 become ineffective thereby releasing the blade sections 25. Since the blade sections 25 are provided with a tapped opening 102 as shown in FIG. 10, a T shaped bolt, not shown, is threaded into the tapped opening 102 and then pulled upwardly to dismount the blade secton. This dismounting is generally done by rotating the entire blade sections about the pivot shaft 13 shown in FIG. 8. The fore ends of the blade sections 25 are then separated from the inking roller 12 so that the blade sections can be dismounted without using any special tools.

Figure 14:
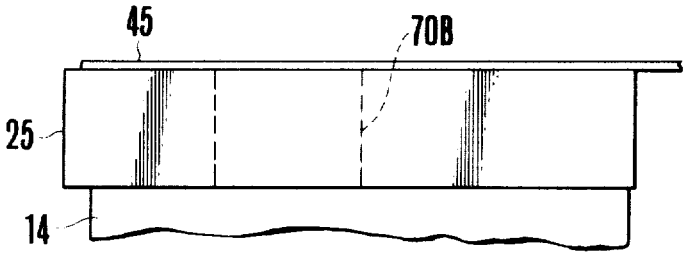

FIGS. 13 through 16 show still other embodiments of this invention. Although in the embodiment shown in FIGS. 8 through 12, both permanent magnets are embedded in the same blade section 25, in the modification shown in FIG. 13, a permanent magnet 70A adapted to firmly attract the blade section to the blade support 14 is embedded in the upper surface of the blade support 14. As shown in FIG. 14, a single magnet 70B having the same length as the thickness of the blade section 25 is contained therein to attract both the thin steel plate 45 and the blade support 14.

Figure 15:
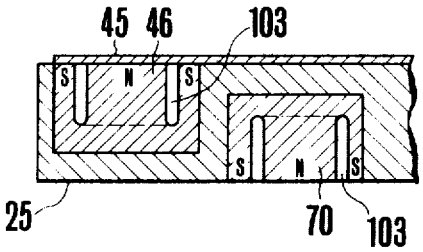
FIGS. 15 and 16 are sectional views showing modified arrangements of the permanent magnets.
Figure 16:
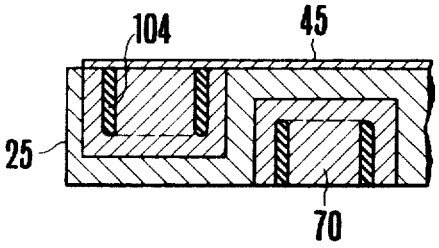

As shown in FIG. 15, each one of the permanent magnets 46 and 70 is constructed as an annular magnet having a central pole. With such annular permanent magnets, the magnetic flux between N and S poles flows through the thin steel plate 45 and the blade support 14 so that the attracting force increases. In still another modification shown in FIG. 16, an annular space 103 between the N and S poles is filled with a nonmagnetic material.

The modification shown in FIGS. 7 through 12 can more finely adjust the quantities of ink supplied from respective blade sections than the first embodiment by the provision of an eccentric pin and a compression spring urging the same.

What is claimed is:

1. An ink fountain device for use in a printing press having an ink fountain containing printing ink, said ink fountain comprising an inking roller immersed in said printing ink contained in said ink fountain; a blade support; a plurality of blade sections juxtaposed on said blade support along the length of said inking roller, each of said blade sections being spaced an independent predetermined distance from the periphery of said inking roller; independent gap adjustment means for each of said blade sections for independently adjusting said predetermined distance between said blade section and the periphery of said inking roller; a thin magnetic plate extended over all of said blade sections, said thin magnetic plate having substantially the same width as the combined width of said blade sections; and a permanent magnet associated with each of said blade sections beneath said thin magnetic plate for attracting said magnetic plate to each of said blade sections.

2. The ink fountain device of claim 1 wherein at least one of said independent gap adjustment means associated with one of said blade sections comprises a stud secured to said blade support and loosely received in an opening of said associated blade section, a compression spring biasing said blade sections away from said inking roller, and an adjusting screw for advancing said blade section toward said inking roller.

3. The ink fountain device of claim 2 wherein said adjusting screw is connected to said associated blade section through link means and an eccentric shaft.

4. The ink fountain device of claim 1 further comprising grease conduits for adjacent surfaces of adjacent blade sections.

5. The ink fountain device of claim 1 wherein at least one of said permanent magnets is embedded in the surface of said associated blade section facing said magnetic plate.

6. The ink fountain device of claim 1 wherein one of said permanent magnets is embedded in the surface of each blade section facing said magnetic plate, said ink fountain device further comprising another of said permanent magnets embedded in the other surface of each blade section facing said blade support.

7. The ink fountain device of claim 1 wherein one of said permanent magnets is embedded in the surface of each blade section facing said magnetic plate, said ink fountain device further comprising another of said permanent magnets affixed to said blade support at a position facing the blade sections associated therewith.

8. The ink fountain device of claim 1 wherein a single permanent magnet is inserted through each blade section, said single permanent magnet having a length equal to a thickness of the blade section associated therewith.

9. The ink fountain device of claim 1 wherein at least one of said permanent magnets comprises an annular member of one polarity and a center member at the center of said annular member and having the opposite polarity of said annular member.

* * * * *